US006939457B2

(12) United States Patent
Mizuno

(10) Patent No.: US 6,939,457 B2
(45) Date of Patent: Sep. 6, 2005

(54) CONTACT-DISCHARGE TRUING/DRESSING METHOD AND DEVICE THEREFOR

(75) Inventor: Masahiro Mizuno, Iwate (JP)

(73) Assignee: Japan Science and Technology Corporation, Kawaguchi (JP)

( * ) Notice: Subject to any disclaimer, the term of this patent is extended or adjusted under 35 U.S.C. 154(b) by 209 days.

(21) Appl. No.: 10/332,773

(22) PCT Filed: Jul. 12, 2001

(86) PCT No.: PCT/JP01/06040

§ 371 (c)(1),
(2), (4) Date: Jan. 13, 2003

(87) PCT Pub. No.: WO02/06008

PCT Pub. Date: Jan. 24, 2002

(65) Prior Publication Data

US 2004/0040864 A1 Mar. 4, 2004

(30) Foreign Application Priority Data

Jul. 14, 2000 (JP) ..... 2000-213605
Jun. 21, 2001 (JP) ..... 2001-188638

(51) Int. Cl.[7] ..... C25F 7/00; C25D 17/00

(52) U.S. Cl. ..... 205/659; 204/215; 204/217; 205/663

(58) Field of Search ..... 205/662–663, 205/658–659; 204/215–217

(56) References Cited

U.S. PATENT DOCUMENTS 4,849,599 A * 7/1989 Kuromatsu ..... 219/69.17
5,108,561 A * 4/1992 Kuromatsu ..... 205/663
5,194,126 A * 3/1993 Packalin ..... 205/663
6,162,348 A * 12/2000 Ohmori ..... 205/663

FOREIGN PATENT DOCUMENTS

JP 78256/1990 6/1990
JP 3-142164 6/1991
JP 4-360765 12/1992

* cited by examiner

*Primary Examiner*—Donald R. Valentine
(74) *Attorney, Agent, or Firm*—Oblon, Spivak, McClelland, Maier & Neustadt, P.C.

(57) ABSTRACT

A contact-discharge truing/dressing method and a device therefor, capable of very simply conducting truing/dressing of a superabrasive grindstone, especially a superabrasive grindstone having a metal binder. The contact-discharge truing/dressing method brings a rotated conductive grindstone into contact with a pair of electrodes to which a DC voltage or pulse voltage is applied, and subjecting the conductive grindstone to an intermittent truing/dressing by contact discharge produced when opening/closing a circuit of a positive electrode, electrode chips, a grindstone binder, electrode chips, a negative electrode, and parts of the side surfaces of dual-ring rotary electrodes insulated by an insulation layer being used as a pair of electrodes.

28 Claims, 14 Drawing Sheets

CONTACT-DISCHARGE TRUING/DRESSING METHOD AND DEVICE THEREFOR

TECHNICAL FIELD

The present invention relates to a method and device for contact-discharge truing/dressing through the use of dual-ring rotary electrodes.

BACKGROUND ART

The superabrasive grindstone has low wear compared with conventional grindstones, and is suitable for high-precision shape creating work. On the other hand, because of the difficulty of its truing/dressing, the superabrasive grindstone is presently not in widespread use.

Out of superabrasive grindstones, with respect to a conductive grindstone using metal or the like as a binder, a technique such as discharge truing/dressing or electrolytic dressing is applied (see The Journal of The Society of Grinding Engineers, Vol. 39, No. 5, 1995, SEP, pp. 21–22, and pp. 25–26). However, any conventional method has been a method executed in a liquid, and has been unsuitable for a dry grinding machine, which prevails in the mold manufacturing industry. The aforementioned method has not been simple because it has needed to use a brush to supply power to the main shaft of a grindstone.

In contrast, there is a contact-discharge truing/dressing method wherein a voltage is applied to a pair of electrodes with an insulating grindstone sandwiched therebetween, wherein the electrodes are ground by a conductive grindstone, and wherein a contact-discharge phenomenon occurring at this time is utilized (see The Journal of The Society of Grinding Engineers, Vol. 39, No. 5, 1995, SEP, p. 24). This method is simple because it does not need to use a brush to supply power to the main shaft of a grindstone.

However, in these conventional contact-discharge truing/dressing methods, because the electrodes are ground while keeping constant the depth of cut of the grindstone with respect to the electrodes and the feed speed of the electrodes, no stable contact-discharge phenomena have been achieved, and in some cases, a problem that periodical irregularities have occurred over the circumference of the grindstone working surface has sen (see 1990, The proceedings of The Japan Society for Precision Engineering, Spring Conference, pp. 933–934.) Also, since the electrodes have been ground largely in a mechanical fashion, wear of the electrodes has been heavy. In addition, this contact-discharge truing/dressing method cannot be applied to a nonconductive grindstone.

There are several other truing/dressing methods wherein abrasives are caused to fall off by mechanically shaving away a binder (this is usually a binder other than metal), using a conventional grindstone rotated (see The Journal of The Society of Grinding Engineers, Vol. 39, No. 5, 1995, SEP, pp. 8–11).

However, when being applied to dry grinding, any method has caused a problem in that large quantities of flying abrasives adversely affect the lifetime of a machine tool and human bodies. Moreover, since the truing/dressing according to these methods relies upon a mechanical force, a problem has occurred in that, when attempting to create a sharp V-shaped edge shape, the edge becomes chipped.

In any of the above-described truing/dressing methods, no measures have been taken to conduct truing/dressing while monitoring the circularity of a grindstone. As a result, it has been impossible to continuously and automatically execute the transition of the truing/dressing condition from the rough truing/dressing condition to the finish truing/dressing condition. Furthermore, it has been impossible to determine while conducting truing/dressing, at what point of time the truing/dressing is to be ended.

In addition, in any of the above-described truing/dressing methods, no measures have been taken to conduct truing/dressing while monitoring the decreasing amount of the radius of a grindstone, due to the truing. As a consequence, in in-process truing/dressing, it has been impossible to perform working while correcting the tool path.

DISCLOSURE OF INVENTION

As described above, any conventional truing/dressing method has involved various problems.

In view of such circumstances, the present invention aims to provide a contact-discharge truing/dressing method and a device therefor capable of very simply performing truing/dressing of a superabrasive grindstone, especially a superabrasive grindstone having a metal binder.

In order to achieve the above-described object, the present invention provides:

[1] a contact-discharge truing/dressing method, comprising the steps of bringing a rotated conductive trued/dressed grindstone into contact with a pair of electrodes to which a DC voltage or pulse voltage is applied, and subjecting the conductive trued/dressed grindstone to an intermittent truing/dressing by contact discharge produced when opening/closing a circuit comprising a positive electrode, electrode chips, a grindstone binder, electrode chips, and a negative electrode, parts of the side surfaces of dual-ring rotary electrodes insulated by an insulator being used as a pair of electrodes.

[2] a contact-discharge truing/dressing method, comprising the steps of bringing a rotated nonconductive trued/dressed grindstone into contact with a pair of electrodes to which a DC voltage or pulse voltage is applied, and subjecting the nonconductive trued/dressed grindstone to an intermittent truing/dressing by contact discharge produced when opening/closing a circuit comprising a positive electrode, electrode chips, and a negative electrode, parts of the side surfaces of dual-ring rotary electrodes insulated by an insulator with a thickness of several hundred $\mu$m or less being used as a pair of electrodes.

[3] a contact-discharge truing/dressing device wherein a rotated conductive trued/dressed grindstone is brought into contact with a pair of electrodes to which a DC voltage or pulse voltage is applied, and wherein the conductive trued/dressed grindstone is subjected to an intermittent truing/dressing by contact discharge produced when opening/closing a circuit comprising a positive electrode, electrode chips, a grindstone binder, electrode chips, and a negative electrode, the contact-discharge truing/dressing device including dual-ring rotary electrodes insulated by an insulator, and a pair of electrodes comprising parts of the side surfaces of the dual-ring rotary electrodes.

[4] a contact-discharge truing/dressing device wherein a rotated nonconductive trued/dressed grindstone is brought into contact with a pair of electrodes to which a DC voltage or pulse voltage is applied, and wherein the nonconductive trued/dressed grindstone is subjected to an intermittent truing/dressing by contact discharge produced when opening/closing a circuit comprising a positive electrode, electrode chips, and a negative electrode, the contact-discharge truing/dressing device including dual-ring rotary electrodes insulated by an insulator with a thickness of several hundred μm or less, and a pair of electrodes comprising parts of the side surfaces of the dual-ring rotary electrodes.

[5] the contact-discharge truing/dressing device set forth in [3] or [4] further comprising a drive mechanism for driving the dual-ring rotary electrodes in the rotating shaft direction thereof.

[6] the contact-discharge truing/dressing device set forth in [3], [4], or [5] further comprising a structure capable of applying a voltage between dual-ring rotary electrodes with mutually different diameters.

[7] the contact-discharge truing/dressing method set forth in [1] or [2] wherein the contact-discharge is performed in an environment of a liquid, a mist, or the air.

[8] the contact-discharge truing/dressing method set forth in [1] or [2] wherein, in order to remove initial rotational deflections of the side surfaces of the dual-ring rotary electrodes, after the side surfaces of the electrodes have been ground by the trued/dressed grindstone without applying a voltage between the electrodes, truing/dressing is started with a voltage applied between the electrodes.

[9] a contact-discharge truing/dressing method, comprising the step of obtaining, using the device set forth in [3], [4], or [5], a predetermined shape of the edge of a grindstone, by providing the electrodes with a feed in the rotating shaft direction thereof in a state in which a predetermined angle is formed between the rotating shaft of the electrodes and that of the trued/dressed grindstone.

[10] a contact-discharge truing/dressing method, comprising the step of disposing, using the device set forth in [3], [4], or [5], a drive device for the dual-ring rotary electrodes, on a numerical-control moving table having a crosswise movement mechanism and a rotational mechanism, to thereby perform high-precision form truing/dressing.

[11] a contact-discharge truing/dressing method, comprising the step of inserting, using the device set forth in [3], [4], or [5], a contact-discharge current limiting resistor and a current detector on the side of the power supply circuit of the device so as to be in series with the pair of electrodes, whereby the feed speed of the dual-ring rotary electrodes in the rotating shaft direction thereof is numerically controlled so that the power consumption between the electrodes becomes the maximum when the contact-discharge current takes on the peak value $I_p$, that is, so that the peak current value $I_p$ becomes $I_p=E/(2R)$ where the power supply voltage is E and the series resistor is R.

[12] the contact-discharge truing/dressing method set forth in [11] wherein the mean value $I_m$ and the peak value $I_p$ of the output from the current detector are acquired at a period of one or more revolutions of the trued/dressed grindstone, and wherein truing/dressing is performed while estimating the circularity of the trued/dressed grindstone, based on the value of $I_m/I_p$.

[13] the contact-discharge truing/dressing method set forth in [12] wherein, based on the estimated circularity of the trued/dressed grindstone, the magnitude of contact-discharge power consumption $E \cdot I_p/2$ is automatically adjusted by a numerical control or an automatic control to thereby perform high-precision truing/dressing.

[14] the contact-discharge truing/dressing method set forth in [12] wherein, when the estimated circularity of the trued/dressed grindstone becomes a predetermined value or less, the truing/dressing is automatically ended.

[15] the contact-discharge truing/dressing method set forth in [11] wherein, in order that a control is performed more stably, the kind of the applied voltage to the dual-ring rotary electrodes is automatically switched between the DC voltage and pulse voltage.

[16] a contact-discharge truing/dressing method, comprising the step of disposing, in the contact-discharge truing/dressing device set forth in [3], [4], or [5], a displacement sensor for measuring the positions of the side surfaces of the electrodes, on the side-surface side of the electrodes to thereby perform truing/dressing while measuring the truing amount.

[17] the contact-discharge truing/dressing device set forth in [3], [4], or [5] further comprising a displacement sensor for measuring the positions of the side surfaces of the electrodes, the displacement censor being provided on the side-surface side of the electrodes.

[18] the contact-discharge truing/dressing method set forth in [16], wherein the contact-discharge truing/dressing method is applied to in-process truing/dressing to thereby execute the method while correcting the tool path based on the truing amount.

[19] the contact-discharge truing/dressing method set forth in [1] or [2], wherein a grindstone is disposed inside the dual-ring rotary electrodes, and wherein adherents of the electrode material adhering to the trued/dressed grindstone are removed for every discharge.

[20] the contact-discharge truing/dressing method set forth in [1] or [2], wherein a grindstone is disposed outside the dual-ring rotary electrodes, and wherein adherents of the electrode material adhering to the trued/dressed grindstone are removed for every discharge.

[21] the contact-discharge truing/dressing device set forth in [3] or [4] further comprising a grindstone disposed inside the dual-ring rotary electrodes.

[22] the contact-discharge truing/dressing device set forth in [3] or [4] further comprising a grindstone disposed outside the dual-ring rotary electrodes.

BEST MODE FOR CARRYING OUT THE INVENTION

Hereinafter, the embodiments of the present invention will be described with reference to the drawings.

Figure 1:
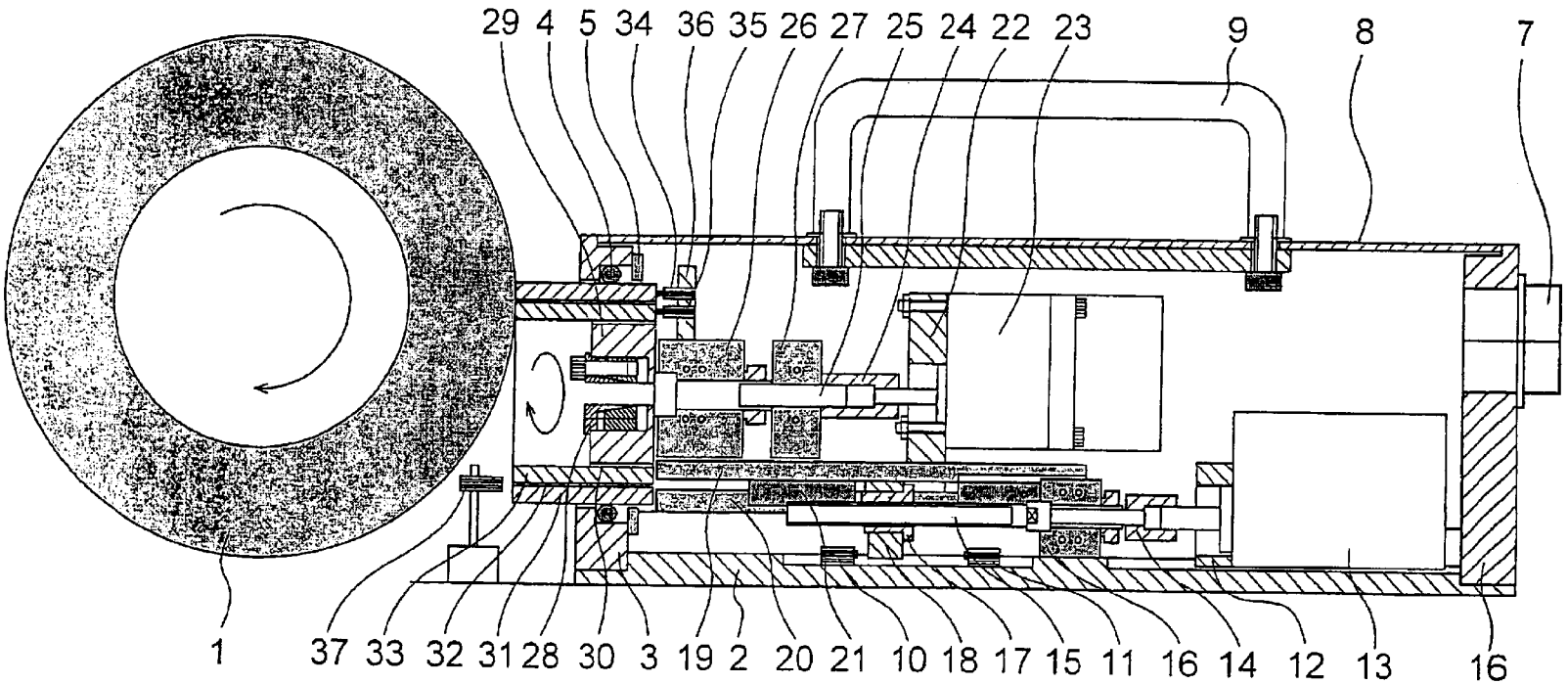
FIG. 1 is a construction view showing an embodiment of a contact-discharge truing/dressing device according to the present invention.

FIG. 1 is a construction view showing an embodiment of a contact-discharge truing/dressing device according to the present invention. This is an example in which a dual-ring rotary electrode type contact-discharge truing/dressing device system is applied to edge truing of a grindstone for profile grinding. In order to facilitate understanding the drawing, in FIG. 1, the rotating shaft of the grindstone for profile grinding and that of the dual-ring rotary electrodes are depicted so as to be perpendicular to each other. In actuality, an angle of 30° was formed between these shafts in order to form the edge of the grindstone for profile grinding into a V-shape with an angle of 30°.

In FIG. 1, reference numeral 1 denotes a grindstone for profile grinding (trued/dressed grindstone), reference numeral 2 a base, reference numeral 3 a front cover, reference numeral 4 an O-ring, reference numeral 5 an O-ring pressing lid, reference numeral 6 a rear cover, reference numeral 7 a connector, reference numeral 8 a cover, reference numeral 9 a handle, reference numeral 10 a front limiter, reference numeral 11 a rear limiter, reference numeral 12 a motor bracket, reference numeral 13 a stepping motor, reference numeral 14 a coupling, reference numeral 15 a ball screw, reference numeral 16 a ball-screw support unit, reference numeral 17 a nut, reference numeral 18 a nut bracket, reference numeral 19 a main-shaft moving table, reference numeral 20 linear guide rails, reference numeral 21 linear guide sliders, reference numeral 22 a motor bracket, reference numeral 23 a DC motor, reference numeral 24 a coupling, reference numeral 25 a main shaft, reference numeral 26 a main-shaft support unit, reference numeral 27 a main-shaft auxiliary support unit, reference numeral 28 a mechanical lock, reference numeral 29 an electrode holder, reference numeral 30 an insulating layer, reference numeral 31 an outer ring of the dual-ring rotary electrodes, reference numeral 32 an insulating layer of the dual-ring rotary electrodes, reference numeral 33 an inner ring of the dual-ring rotary electrodes, each of reference numerals 34 and 35 a power-supply brush, reference numeral 36 a power-supply brush bracket, and reference numeral 37 a displacement sensor.

First, the structure of the dual-ring rotary electrode type contact-discharge truing/dressing device is described with reference to FIG. 1.

The ball screw support unit 16 is fixed to the base 2, thereby supporting the ball screw 15 with a pitch of 1 mm. One end of the ball screw 15 is connected to the rotating shaft of the stepping motor 13 through the coupling 14, and is subjected to a rotational drive at a step angle of 0.1°. Here, the stepping motor 13 is fixed to the base 2 by the motor bracket 12.

The nut 17 meshes with the ball screw 15, and is fed in the rotating shaft direction by the rotation of the stepping motor 13. The nut bracket 18 is fixed to the nut 17, and when the nut bracket 18 presses the switch of the front limiter 10 or the rear limiter 11, the stepping motor stops.

The two linear guide rails 20 extending in the rotating shaft direction of the electrodes are fixed to the base 2 in parallel with each other. The two linear guide sliders 21 are mounted on each of the linear guide rails 20. The main-shaft moving table 19 is fixed to the linear guide sliders 21 and the nut bracket 18, and is driven by the stepping motor 13 in the rotating shaft direction of the electrodes.

The main shaft 25 is supported by the main-shaft support unit 26 and the main-shaft auxiliary support unit 27, which are fixed to the moving table, and one end thereof is connected to the DC motor 23 for rotationally driving the main shaft 25 through the coupling 24. Here, the DC motor 23 is fixed to the main-shaft moving table 19 using the motor bracket 22.

Carbon (or copper) was used for an electrode material of the outer ring 31 and the inner ring 33 of the dual-ring rotary electrodes, and an epoxy resin was used for the insulating layer 32 of the dual-ring rotary electrodes, which insulates the inner and outer rings. Here, the thickness of the insulating layer was set to about 500 μm. The dual-ring rotary electrodes and the electrode holder 29 are adhered to each other by the insulating layer 30 comprising a thermoplastic resin with a high insulation property. The dual-ring rotary electrodes comprising the dual-ring rotary electrode outer ring 31, the dual-ring rotary electrode inner ring 33, and the dual-ring rotary electrode insulating layer 32, and the electrode holder 29, are fixed to the main shaft 25 by means of the mechanical lock 28.

The spring-loaded power-supply brushes 34 and 35 are in contact with the outer ring 31 and the inner ring 33 of the dual-ring rotary electrodes, thereby implementing power supply. These power-supply brushes 34 and 35 are supported by the bakelite-made power-supply brush bracket 36 fixed to the main-shaft moving table 19. This embodiment is not one in which a power supplying method of certain embodiments of the present invention is adopted.

The displacement sensor 37 is disposed on the table of the grinding machine or the base 2, and monitors the edge portion of the grindstone for profile grinding by measuring the positions of the electrode side surfaces.

Figure 2:
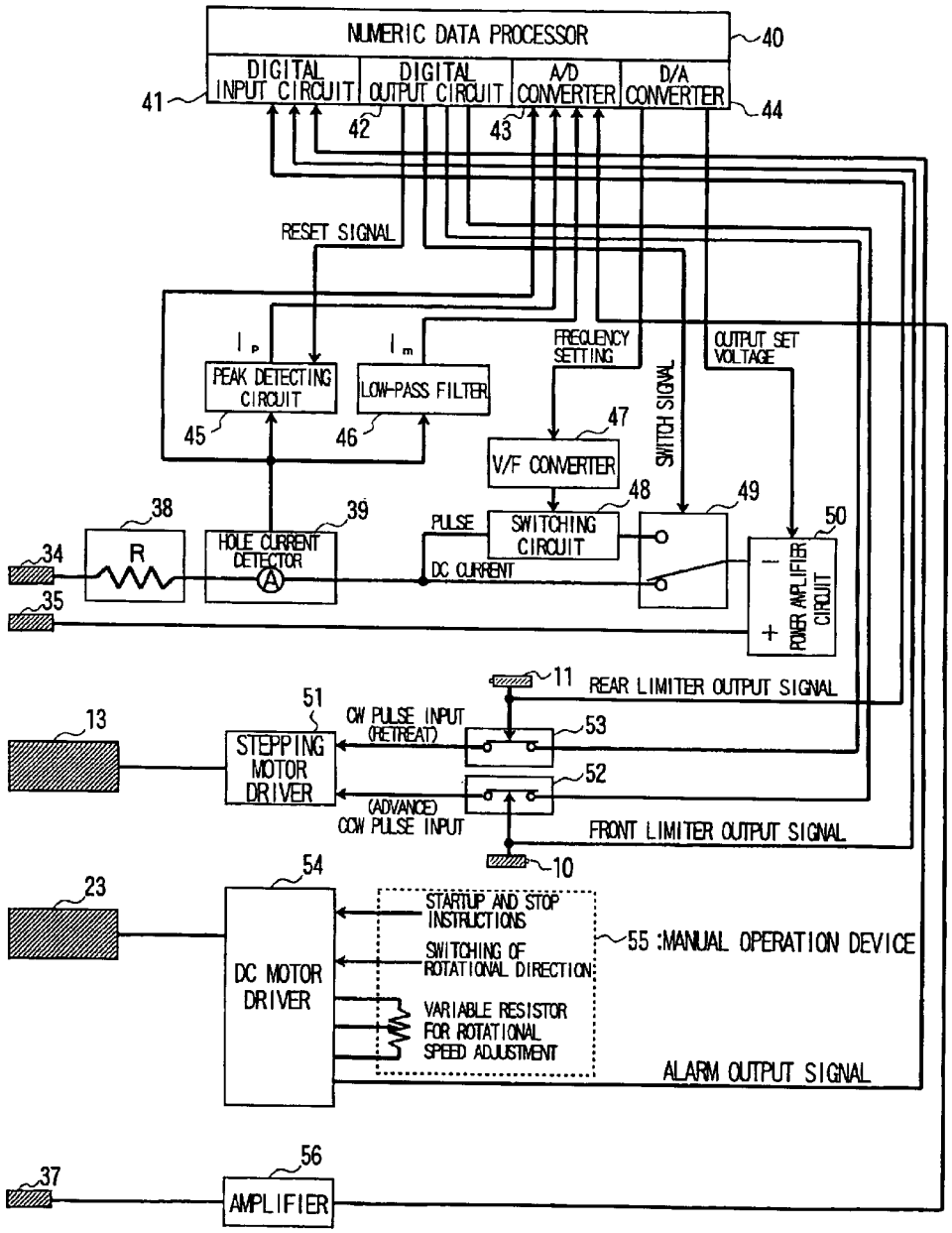
FIG. 2 is a block diagram of an embodiment of a control device of the contact-discharge truing/dressing device according to the present invention.

FIG. 2 is a block diagram of an embodiment of a control device of the contact-discharge truing/dressing device according to the present invention.

In FIG. 2, reference numeral 38 designates a discharge current limiting resistor, reference numeral 39 a hole current detector, reference numeral 40 a numeric data processor, reference numeral 41 a digital input device, reference numeral 42 a digital output device, reference numeral 43 an A/D converter, reference numeral 44 a D/A converter, reference numeral 45 a peak detecting circuit, reference numeral 46 a low-pass filter, reference numeral 47 a V/F converter, reference numeral 48 a switching circuit, reference numeral 49 a Y-shaped relay, reference numeral 50 a power amplifier circuit, reference numeral 51 a stepping motor driver, each of reference numerals 52 and 53 an analog switch, reference numeral 54 a DC motor driver, reference numeral 55 a manual operation device, and reference numeral 56 an amplifier.

Now the control device will be described with reference to FIG. 2.

For control, the numeric data processor 40 is used that comprises the digital input and output devices 41 and 42, the A/D converter 43, and the D/A converter 44.

As the power supply for a discharge circuit, the power amplifier circuit 50 in a power operating amplifier is used, and the output voltage of the power supply can be set by an instruction from the numeric data processor 40. This makes it possible to continuously change the truing condition from the rough truing condition to the finish truing condition. Here, the output of the power amplifier circuit 50 is electrically insulated from a commercial power supply and the ground for safety.

The positive electrode of the power amplifier circuit 50 is directly connected to the power-supply brush 35. On the other hand, the negative electrode of the power amplifier circuit 50 is connected to the Y-shaped relay 49 changeable by an instruction from the numeric data processor 40, and the switching between the DC voltage and pulse voltage is performed at the Y-shaped relay 49. When a pulse voltage is selected, the output passes through the switching circuit 48 comprising an electric field effect transistor, and is then connected to the power-supply brush 34 through the hole current detector 39 and the discharge current limiting resistor 38. On the other hand, when a DC voltage is selected, the output does not pass through the switching circuit 48. Here, the switching frequency of the switching circuit 48 can be set by an instruction from the numeric data processor 40, by using the V/F converter (voltage-frequency converter) 47.

The output from the hole current detector 39 is separated into three paths and is taken in the numeric data processor 40. A first path is one for directly taking in the output. A second path is one for taking in the output after passing through the peak detecting circuit 45. The peak value $I_p$ of the contact-discharge current is obtained from the signal voltage of this second path. Upon receipt of an instruction from the numeric data processor 40, the peak detecting circuit 45 is reset to a period of one or more revolutions of the grindstone. A third path is one for taking in the output after passing through the low-pass filter 46. The mean value $I_m$ of the contact-discharge current is obtained from the signal voltage of this third path.

The stepping motor 13 is driven in response to the output from the hole current detector 39. Specifically, the rotational speed and the rotational direction of the stepping motor 13 are numerically controlled so that the power consumption between the electrodes becomes the maximum when the contact-discharge current takes on the peak value $I_p$, that is, so that the above-described peak current value $I_p$ becomes $I_p=E/(2R)$ where the power supply voltage is E. Also, when the front limiter 10 or the rear limiter 11 is pressed, an input pulse to the stepping motor driver 51 is shut down by the analog switches 52 or 53. The output signals from the front limiter 10 and the rear limiter 11 are sent also to the numeric data processor 40.

The startup and stop instructions, the switching of rotational direction, and the adjustment of rotational speed are all manually executed in the manual operation device 55. Only the signal line of the alarm output signal issued when something out of the ordinary takes place in the DC motor 23, is connected to the numeric data processor 40, so that an emergency measure can be taken.

After being amplified by the amplifier 56, the output of the displacement sensor 37 is taken in the numeric data processor 40, and is used for monitoring the edge position of the grindstone 1 for profile grinding (see FIG. 1).

Figure 3:
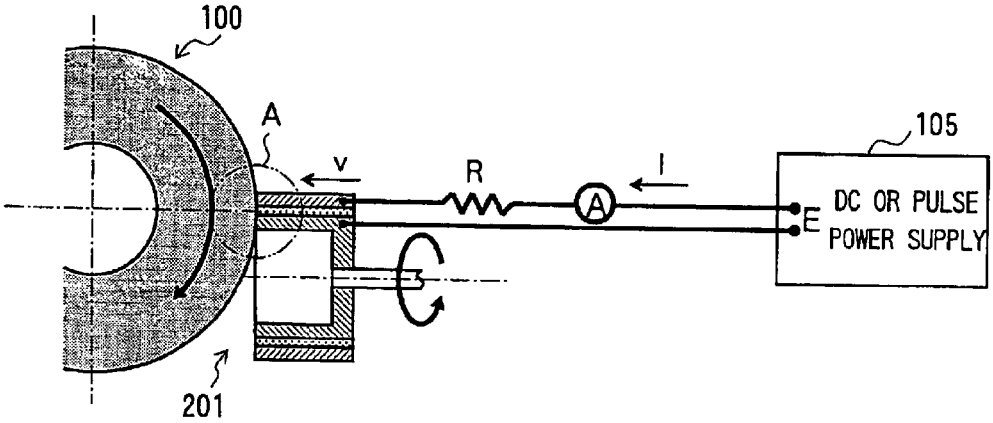
FIG. 3 is an explanatory view of an embodiment of a contact-discharge truing/dressing method according to the present invention.
Figure 4:
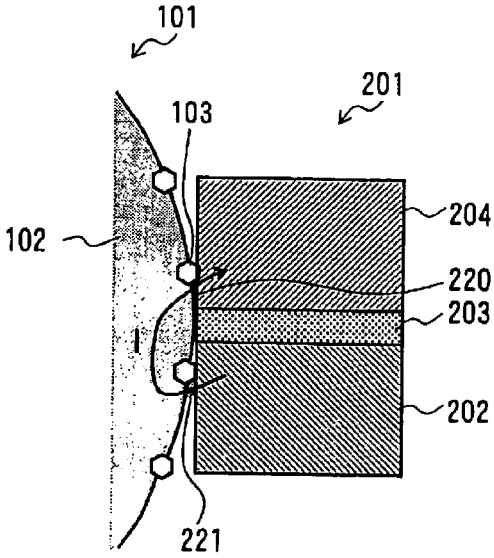
FIG. 4 is an enlarged view (Part 1) showing the portion A in FIG. 3 to explain the truing/dressing mechanism thereof.
Figure 5:
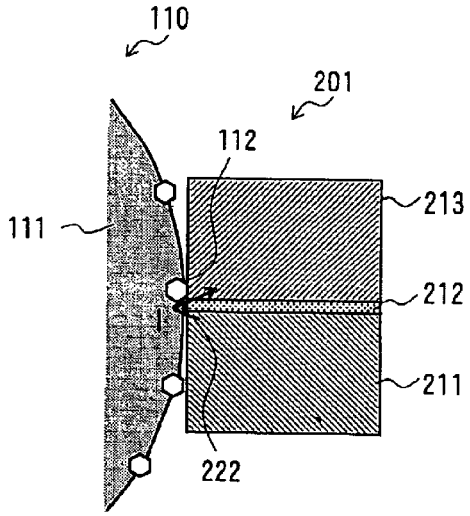
FIG. 5 is an enlarged view (Part 2) showing the portion A in FIG. 3 to explain the truing/dressing mechanism thereof.

FIG. 3 is an explanatory view of an embodiment of a contact-discharge truing/dressing method according to the present invention, and FIGS. 4 and 5 are enlarged views showing the portion A in FIG. 3 to explain the truing/dressing mechanism thereof.

For example, as shown in FIG. 4, a dual-ring rotary electrodes 201 comprising an electrode inner ring 202, an insulating layer 203, and an electrode outer ring 204, is used. A DC voltage or pulse voltage is applied between the electrode inner ring 202 and the electrode outer ring 204, thereby rotating the dual-ring rotary electrodes 201. When the dual-ring rotary electrodes 201 is fed in the rotating shaft direction thereof, and the side surfaces thereof are brought in contact with the conductive grindstone 101, contact discharge occurs at the portions of electrode chips 220 and 221, in a circuit comprising the electrode outer ring 204, the electrode chips 220, the conductive binder 102, the electrode chips 221, and the electrode inner ring 202. The conductive binder 102 is melted by the heat due to the above-described contact discharge, so that abrasives 103 fall off. In the truing device shown in FIG. 4, the insulating layer 203 may have a thickness of several hundred μm or more.

In contrast, as shown in FIG. 5, if the thickness of the insulating layer 212 of the dual-ring rotary electrodes 201 is set to several hundred μm or less, the present contact-discharge truing/dressing method can also be applied to the truing of the nonconductive grindstone 110. In this case, when the side surfaces of the dual-ring rotary electrodes 201 are brought in contact with the nonconductive grindstone 110, contact discharge occurs at the portion of electrode chips 222, in a circuit comprising the electrode outer ring 213, the electrode chips 222, and the electrode inner ring 211. The nonconductive binder 111 is melted by the heat due to the above-described contact discharge, so that the abrasives 112 fall off. In this manner, reducing the thickness of the insulating layer between the electrodes allows the truing/dressing with respect to a nonconductive grindstone, as well.

These methods are simple because they do not need to use a brush to supply power on the main shaft of the trued/dressed grindstone 100. In addition, these methods allow the truing/dressing to be performed under a dry grinding condition, as well.

The control of the discharge power in the contact-discharge is implemented as follows. As shown in FIG. 3, a discharge current limiting resistor R and a hole current detector A are inserted on the power supply side so as to be in series with the pair of electrodes. In this circuit, when the current value I=E/(2R), the contact-discharge power becomes the maximum with respect to the power supply voltage E. When there are deflections on the trued surface, the current I varies at the rotational period of the grindstone 100. However, if the feed speed v of the electrodes in the rotating shaft direction thereof is controlled so that the maximum value $I_p$ of the current value I becomes $I_p$=E/(2R), it is possible to efficiently remove the largest portion of the deflections. Here, reference numeral 105 denotes a DC or pulse power supply.

Figure 6:
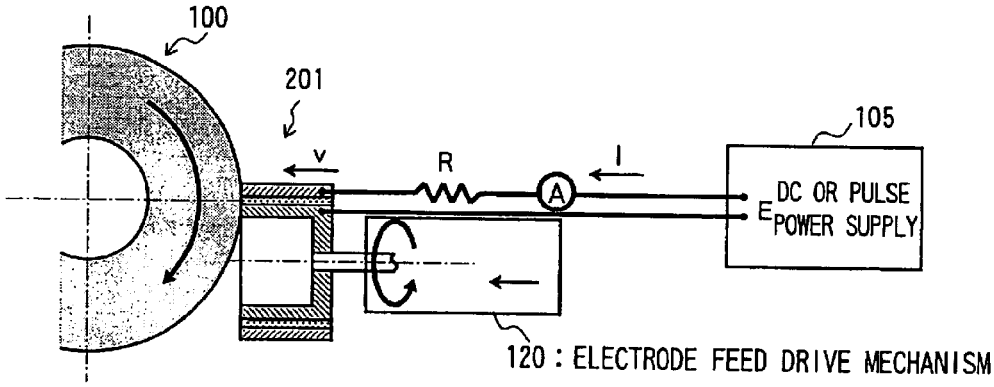
FIG. 6 is a construction view showing the main section of an embodiment of a contact-discharge truing/dressing device having an electrode feed mechanism according to the present invention.

FIG. 6 is a construction view showing the main section of an embodiment of a contact-discharge truing/dressing device having an electrode feed mechanism according to the present invention.

As shown in FIG. 6, the present contact-discharge truing/dressing device is configured so that the dual-ring rotary electrodes 201 are fed in the rotating shaft direction thereof by an electrode feed mechanism 120. Here, reference numeral 100 denotes a grindstone, and reference numeral 105 denotes a DC or pulse power supply.

Figure 7:
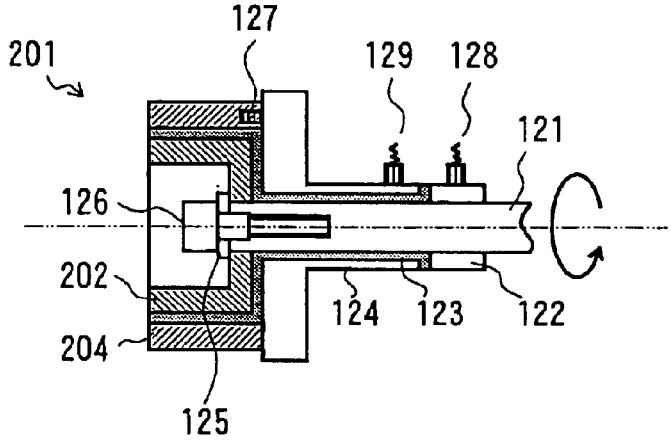
FIG. 7 is a construction view showing an embodiment of a power supply mechanism of the contact-discharge truing/dressing device according to the present invention.

FIG. 7 is a construction view showing an embodiment of a power supply mechanism of the contact-discharge truing/dressing device according to the present invention.

In FIG. 7, reference numeral 121 designates the rotational main shaft of the dual-ring rotary electrodes 201, reference numeral 122 a conductor ring fixed to the aforementioned rotational main shaft 121, reference numeral 123 an insulating layer, reference numeral 124 an electrode flange, reference numeral 125 a washer, reference numeral 126 an electrode fixing bolt for electrically interconnecting the rotational main shaft 121 and the electrode inner ring 202, reference numeral 127 a power-supply spring for electrically interconnecting the electrode outer ring 204 and the electrode flange 124, and each of reference numerals 128 and 129 a power-supply brush.

In this way, a power is supplied to the electrode inner ring 202 through the power-supply brush 128, the conductor ring 122, the rotational main shaft 121, the electrode fixing bolt 126, and the washer 125, and is supplied to the electrode outer ring 204 through the power-supply brush 129, the electrode flange 124, and the power-supply spring 127.

Figure 8:
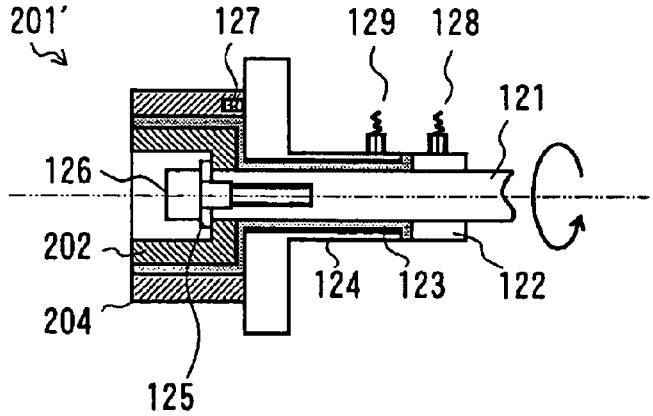
FIG. 8 is a sectional view showing an example of dual-ring rotary electrodes with a diameter different from that of the contact-discharge truing/dressing device shown in FIG. 7.

FIG. 8 is a sectional view showing an example of dual-ring rotary electrodes with a diameter different from those of the contact-discharge truing/dressing device shown in FIG. 7.

As shown in FIG. 8, in this embodiment, there are provided dual-ring rotary electrodes 201' with a smaller diameter.

Figure 9A:
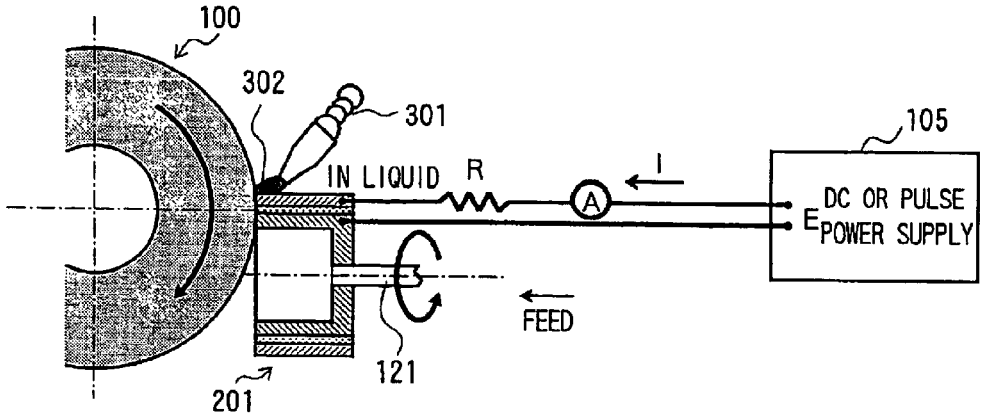
FIGS. 9A to 9C are explanatory views of various types of contact-discharge truing/dressing methods.
Figure 9B:
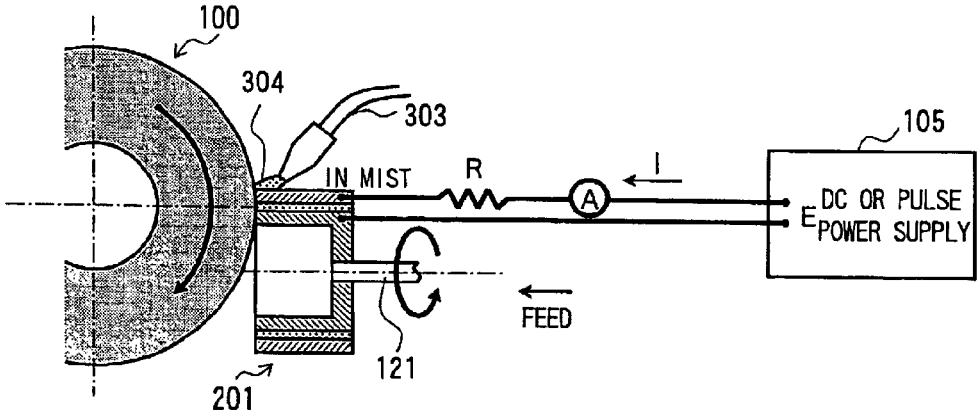
Figure 9C:
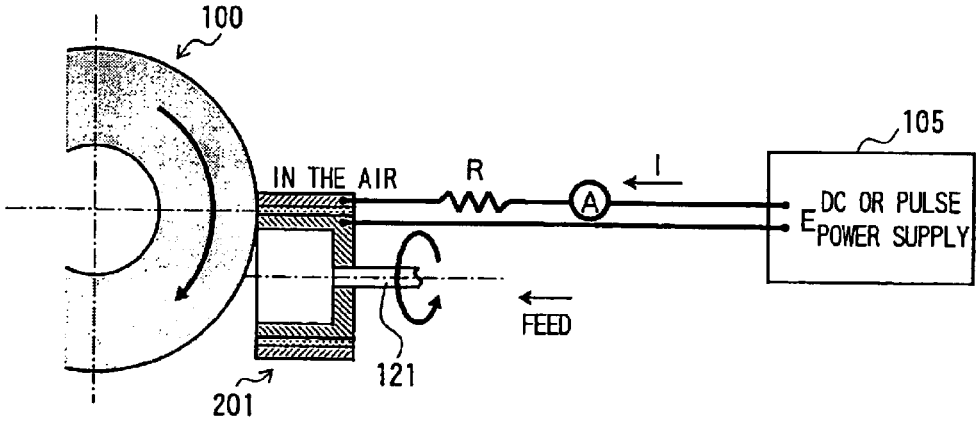

FIGS. 9A to 9C are explanatory views of various types of contact-discharge truing/dressing methods according to the present invention. In FIGS. 9A to 9C, the contact-discharge operations performed in environments of a liquid, a mist, and the air, are respectively shown. In FIGS. 9A to 9C, the same parts as those in FIG. 3 are designated by the same reference numerals, and the descriptions thereof are omitted.

Specifically, as shown in FIG. 9A, when a contact-discharge operation is performed in a liquid, a nozzle 301 for liquid supply is disposed at the contact discharge position, and a contact-discharge is caused to take place while supplying a liquid 302.

Also, as shown in FIG. 9B, when a contact-discharge operation is performed in a mist, a nozzle 303 for mist supply is disposed at the contact discharge position, and a contact-discharge is caused to take place while supplying a mist 304.

Of course, as shown in FIG. 9C, a contact-discharge operation may be performed in the air without supplying anything.

Figure 10:
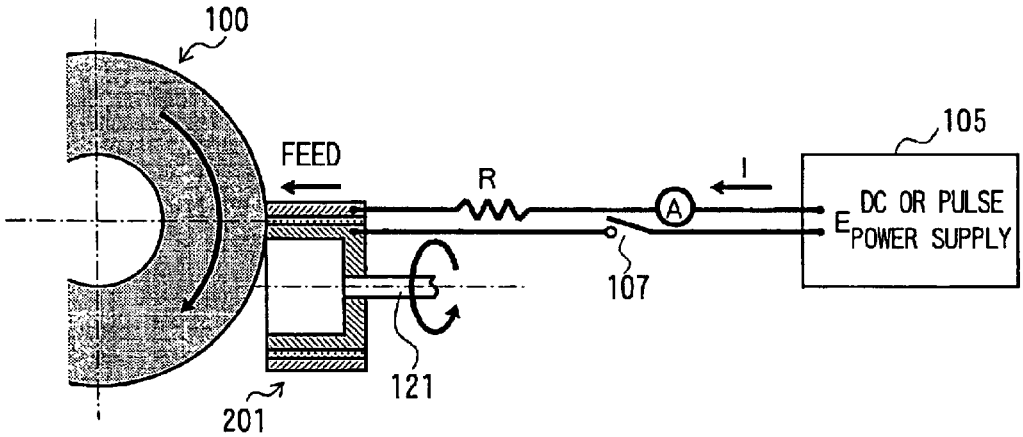
FIG. 10 is a representation of an embodiment of a method of the present invention for removing rotational deflections on the side surfaces of the electrodes according to the present invention.

FIG. 10 is a representation of an embodiment of a method of the present invention for removing rotational deflections on the side surfaces of the electrodes.

As shown in FIG. 10, in order to removing initial rotational deflections on the side surfaces of the electrodes 201, a switch 107 is turned off, and the side surfaces of the electrodes are ground by the trued/dressed grindstone 100 without applying a voltage between the inner ring and the outer ring of the electrodes. Thereafter, with a voltage applied between the inner ring and the outer ring of the electrodes, truing/dressing operation is started.

Figure 11:
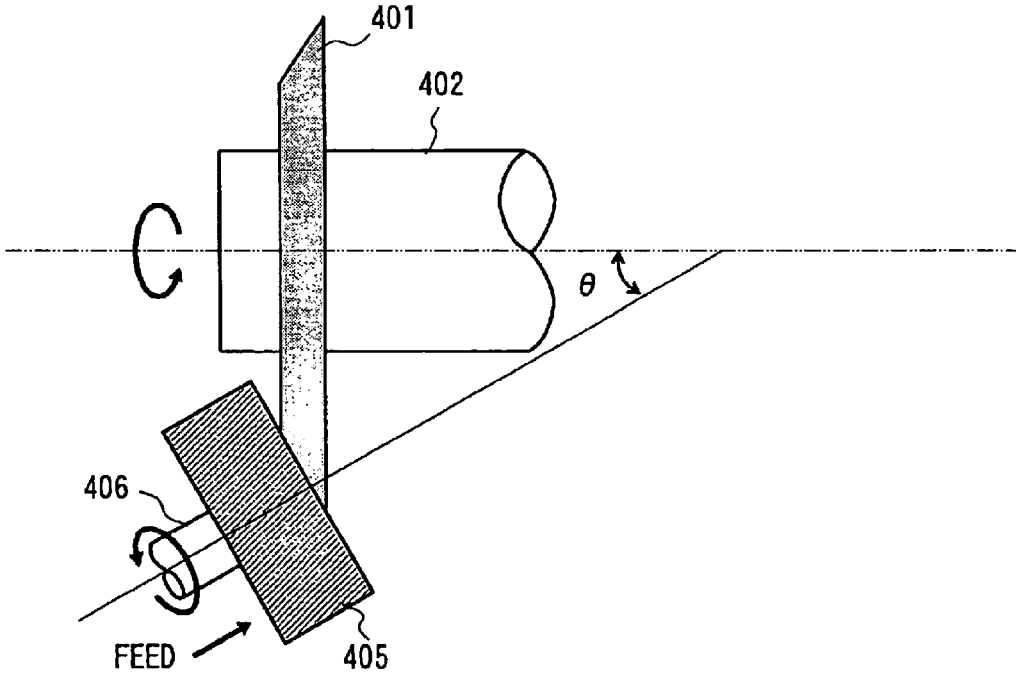
FIG. 11 is a representation of an embodiment of a contact-discharge truing/dressing method of the present invention for obtaining a V-shaped grindstone edge shape.

FIG. 11 is a representation of an embodiment of a contact-discharge truing/dressing method of the present invention for obtaining a V-shaped grindstone edge shape.

In this embodiment, a predetermined edge shape of a grindstone can be obtained by providing a dual-ring rotary electrodes 405 with a feed in the direction of a rotating main shaft 406 thereof, in a state in which a predetermined angle θ is formed between the rotating main shaft 406 of the dual-ring rotary electrodes 405 and the rotating shaft 402 of a grindstone 401.

Figure 12:
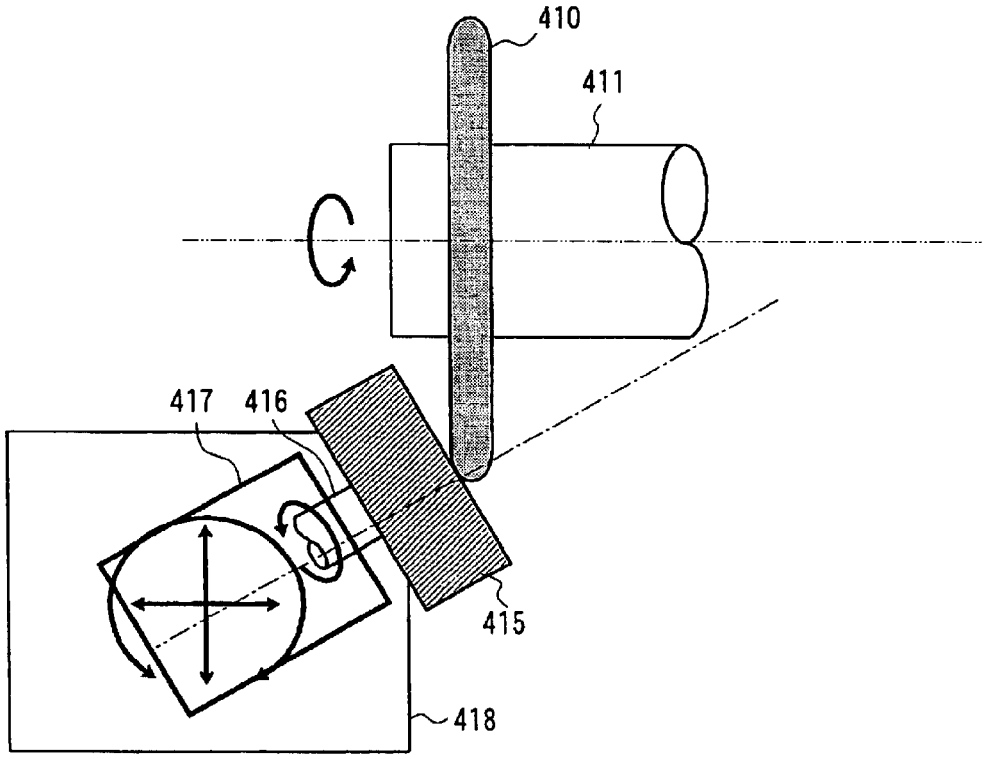
FIG. 12 is a construction view showing an embodiment of a contact-discharge truing/dressing device of the present invention in which a drive device for the dual-ring rotary electrodes is disposed on a numerical-control moving table having a crosswise movement mechanism and a rotational mechanism.

FIG. 12 is a construction view showing an embodiment of a contact-discharge truing/dressing device of the present invention in which a drive device for the dual-ring rotary electrodes is disposed on a numerical-control moving table having a crosswise movement mechanism and a rotational mechanism.

In this embodiment, a drive device for a dual-ring rotary electrodes 415 is disposed on a numerical-control moving table 418 having a crosswise movement mechanism and a rotational mechanism. Specifically, when contact-discharge truing/dressing is performed by bringing the dual-ring rotary electrodes 415 into contact with a grindstone 410 fixed to a grindstone rotating shaft 411, a drive mechanism for the rotating main shaft 416 of the dual-ring rotary electrodes 415, and consequently, the main body 417 of the truing/dressing device is disposed on the numerical-control moving table 418 having the crosswise movement mechanism and the rotational mechanism. This makes it possible to perform high-precision form truing/dressing.

Figure 13A:
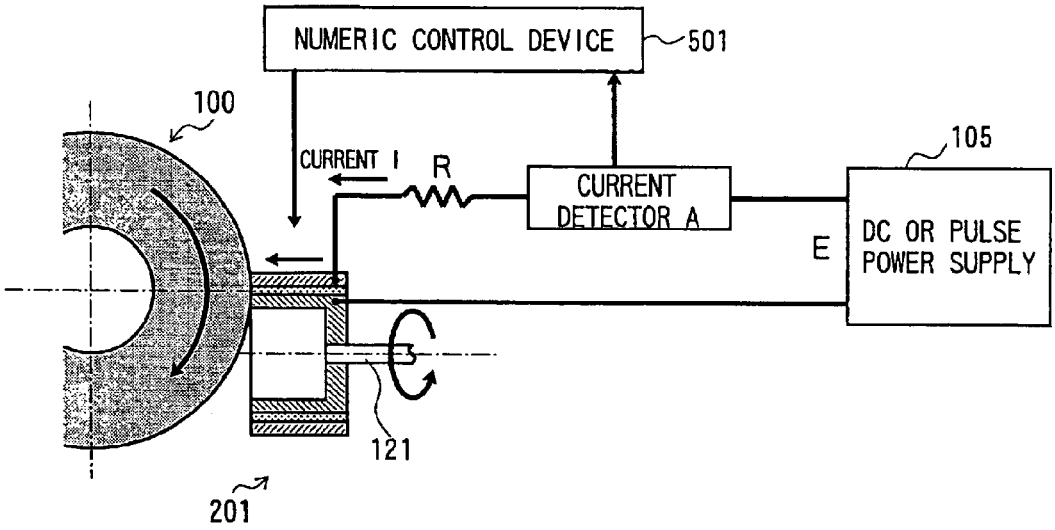
FIGS. 13A and 13B are explanatory views of an embodiment of a method of the present invention for numerically controlling the feed speed of the dual-ring rotary electrodes in the rotating shaft direction thereof.
Figure 13B:
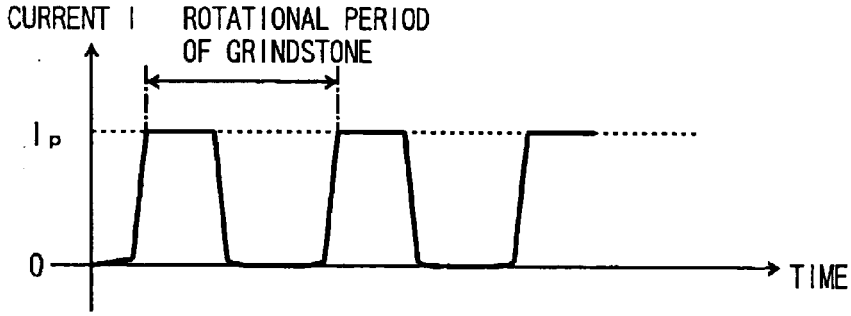

FIGS. 13A and 13B are explanatory views of an embodiment of a method of the present invention for numerically controlling the feed speed of the dual-ring rotary electrodes in the rotating shaft direction thereof, where FIG. 13A is a construction view of the present system, and FIG. 13B is a waveform view of a current under a numeric control.

In this embodiment, a contact-discharge current limiting resistor R and a current detector A are inserted on the side of the power supply circuit of this device so as to be in series with the dual-ring rotary electrodes 201, and the feed speed of the dual-ring rotary electrodes 201 in the direction of the rotating shaft 121 is controlled by a numeric control device 501 so that the power consumption between the dual-ring rotary electrodes 201 becomes the maximum when the contact-discharge current takes on the peak value $I_p$, that is, so that the above-described peak current value $I_p$ becomes $I_p$=E/(2R) where the power supply voltage is E.

Thereby, it is possible to maintain the contact-discharge state very stable, and inhibit the periodical irregularities from occurring on the working surface of the grindstone. Also, this reduces the ratio of the electrode portion that is vainly ground in a mechanical fashion, thereby decreasing wear of the electrodes, which leads to the conservation of work environment in a clean state.

Figure 14A:
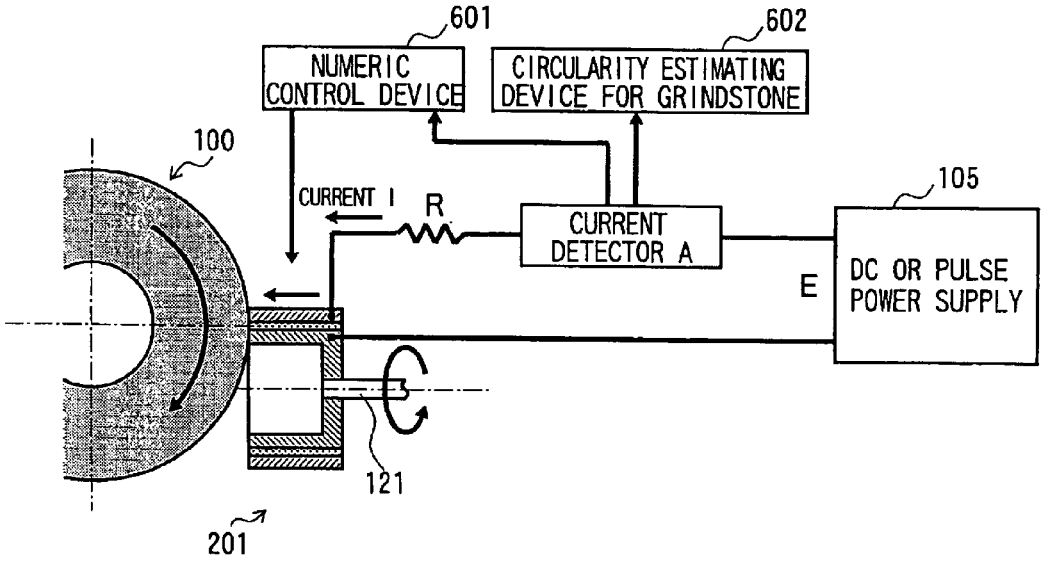
FIGS. 14A and 14B are explanatory views of an embodiment of a method of the present invention for estimating the circularity of a grindstone.
Figure 14B:
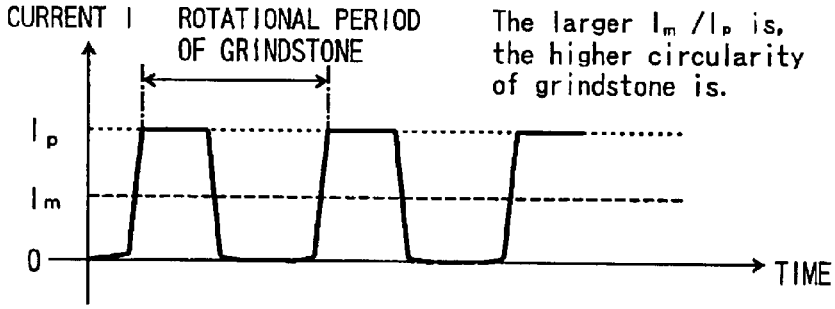

FIGS. 14A and 14B are explanatory views of an embodiment of a method of the present invention for estimating the circularity of a grindstone, where FIG. 14A is a construction view of the present system, and FIG. 14B is a waveform view of a current under a numeric control.

In this embodiment, the mean value $I_m$ and the peak value $I_p$ of the output from the current detector A are acquired at a period of one or more revolutions of the grindstone, and truing/dressing is performed while estimating the circularity of the grindstone, based on the value of $I_m/I_p$. Namely, there is provided a circularity estimating device 602 for estimating the circularity of a grindstone, based on the $I_m/I_p$ value. As shown in FIG. 14B, the larger the $I_m/I_p$ value is, the higher the circularity of the grindstone is. Here, reference numeral 601 denotes a numeric control device for numerically controlling the electrode feed speed so that the peak value $I_p$ of the current I becomes $I_p$=E/(2R).

As described above, the mean value $I_m$ and the peak value $I_p$ of the output from the current detector A are measured at a period of one or more revolutions of the grindstone, so that truing/dressing can be performed while estimating the circularity of the grindstone, based on the value of $I_m/I_p$. Therefore, it is possible to automate the continuous transition of the truing/dressing condition from the rough truing/dressing condition to the finish truing/dressing condition, as well as the determination as to at what point of time the truing/dressing is to be ended.

Figure 15:
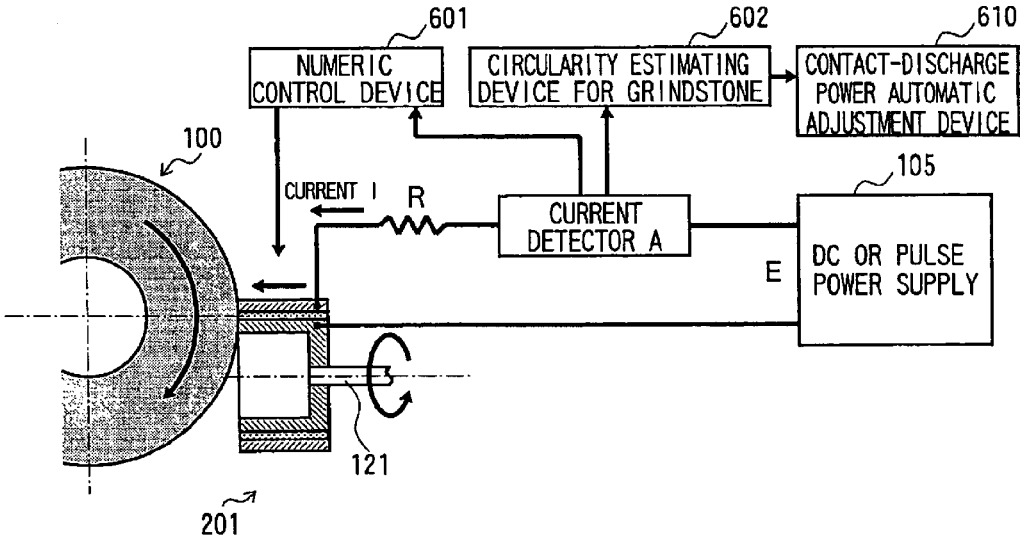
FIG. 15 is an explanatory view of an embodiment of a method of the present invention for automatically adjusting the magnitude of contact-discharge power consumption $E \cdot I_p/2$ by a numerical control or an automatic control, based on the circularity of a grindstone.

FIG. 15 is an explanatory view of an embodiment of a method of the present invention for automatically adjusting the magnitude of contact-discharge power consumption $E \cdot I_p/2$ by a numerical control or an automatic control, based on the circularity of a grindstone.

In this embodiment, there is provided a contact-discharge power automatic adjustment device 610 that automatically adjusts the contact-discharge power consumption $E \cdot I_p/2$, based on the mean value $I_m$ and the peak value $I_p$ of the output from the current detector A, and high precision truing/dressing is performed by automatically adjusting the magnitude of the contact-discharge power consumption $E \cdot I_p/2$ by a numeric control or an automatic control, based on the estimated value of the circularity of the grindstone.

Figure 16:
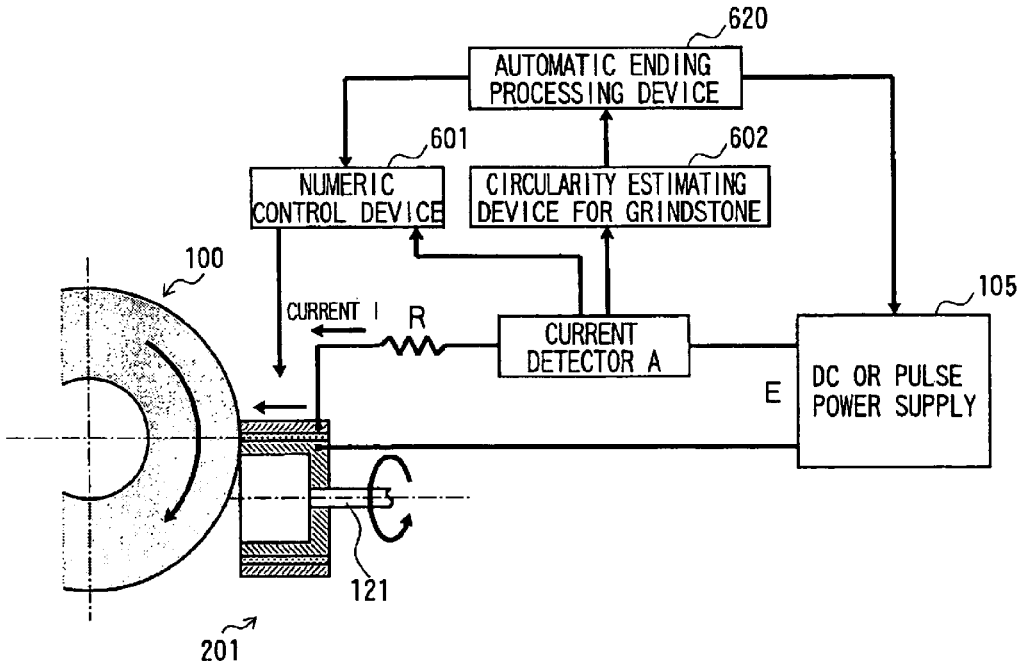
FIG. 16 is an explanatory view of an embodiment of a method of the present invention for automatically ending contact-discharge truing/dressing when the estimated value of the circularity of the grindstone becomes a predetermined value.

FIG. 16 is an explanatory view of an embodiment of a method of the present invention for automatically ending contact-discharge truing/dressing when the estimated value of the circularity of the grindstone becomes a predetermined value.

In this embodiment, there is provided an automatic ending processing device 620 that automatically performs end processing of the contact-discharge truing/dressing when the estimated value of the circularity of the grindstone becomes a predetermined value, whereby truing/dressing can be automatically ended when the circularity of the grindstone becomes a satisfactory value.

Figure 17:
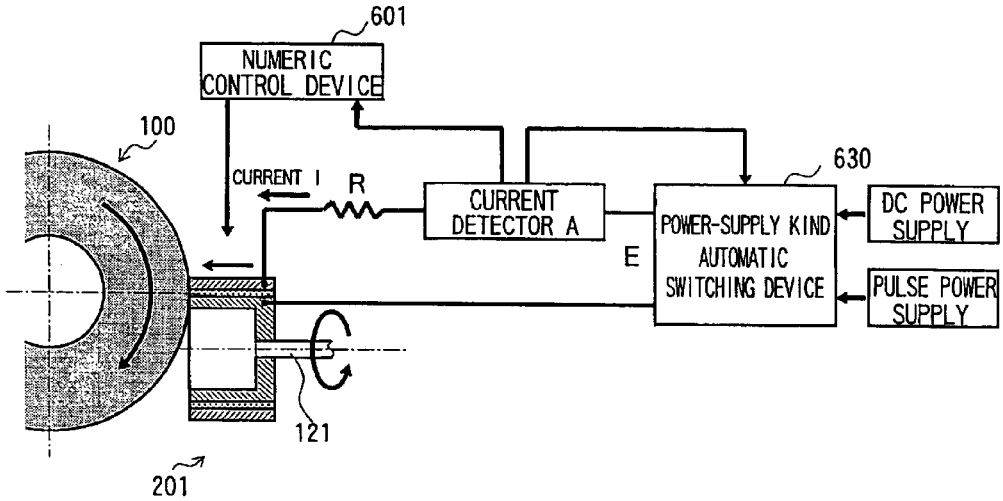
FIG. 17 is an explanatory view of an embodiment of a method of the present invention for automatically switching the kind of the voltage to be applied to the dual-ring rotary electrodes, between the DC voltage and pulse voltage, in order that a control is performed more stably.

FIG. 17 is an explanatory view of an embodiment of a method of the present invention for automatically switching the kind of the voltage to be applied to the dual-ring rotary electrodes, between the DC voltage and pulse voltage, in order that a control is performed more stably.

In this embodiment, there is provided an automatic switching device 630 that automatically switches the kind of the voltage to be applied to the dual-ring rotary electrodes, between the DC voltage and pulse voltage, so that the control is more stably performed.

Figure 18:
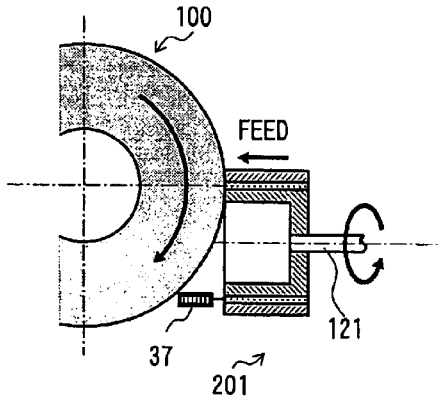
FIG. 18 is an explanatory view of an embodiment of a method of the present invention for performing contact-discharge truing/dressing while measuring the truing amount.

FIG. 18 is an explanatory view of an embodiment of a method of the present invention for performing contact-discharge truing/dressing while measuring the truing amount.

In this embodiment, a displacement sensor 37 for measuring the positions of the side surfaces of the electrodes is disposed on the side of the electrode side-surfaces, and truing/dressing is performed while measuring the truing amount.

Figure 19:
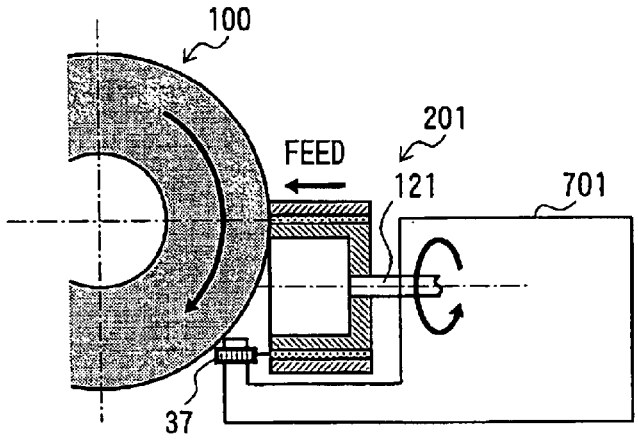
FIG. 19 is a representation of a modification of the method for performing truing/dressing shown in FIG. 18.

As shown FIG. 19, the displacement sensor 37 may be disposed in the main body 701 of the truing device.

Disposing a displacement sensor for measuring the positions of the side surfaces of the electrodes, on the side of the electrode side-surfaces in this manner, allows the truing amount by the contact-discharge truing/dressing to be monitored. When this is applied to in-process truing/dressing, it is possible to perform working while correcting the tool path.

Figure 20:
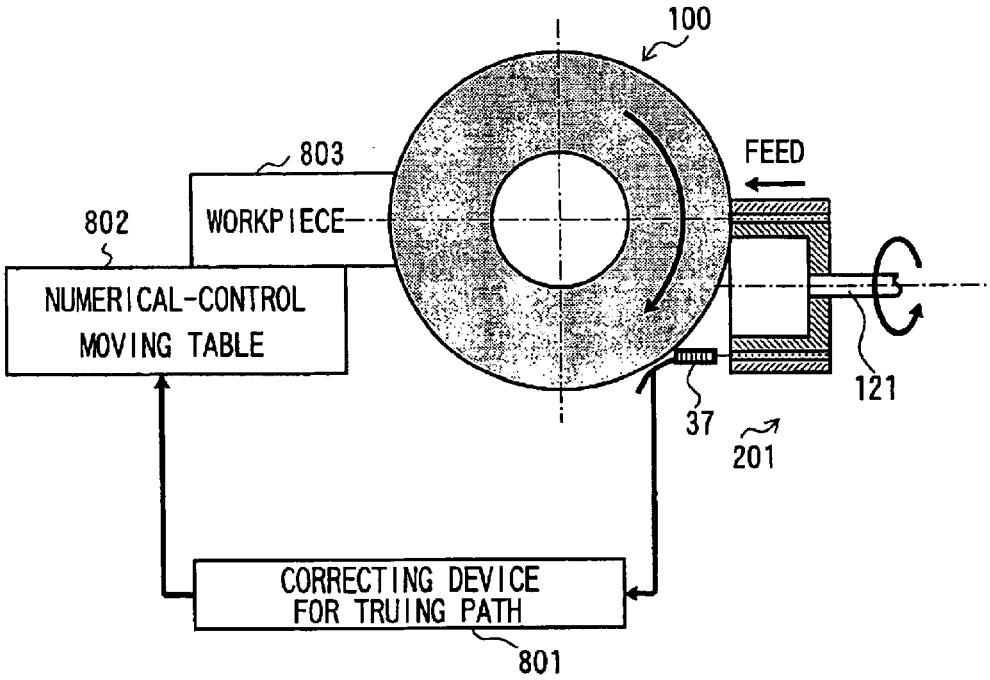
FIG. 20 is an explanatory view of an embodiment of a contact-discharge truing/dressing method according to the present invention that is applied to in-process truing/dressing, and that is executed while correcting the tool path based on the truing amount.

FIG. 20 is an explanatory view of an embodiment of a contact-discharge truing/dressing method according to the present invention that is applied to in-process truing/dressing, and that is executed while correcting the tool path based on the truing amount.

In FIG. 20, reference numeral 801 designates a correcting device for truing path based on the truing amount upon receipt of an output signal from the sensor 37, and reference numeral 802 designates a numerical-control moving table loaded with a workpiece 803.

This embodiment is applied to in-process truing/dressing, and is arranged to perform contact-discharge truing/dressing while correcting the tool path based on the truing amount.

However, when truing/dressing is performed by the above-described method, an electrode material adheres to the projecting portions (portions where deflections are large) of the trued/dressed grindstone, and consequently, there is possibility that a phenomenon occurs in which the electrodes continue to retreat. To solve this problem, it is effective to have the following arrangement.

Figure 21:
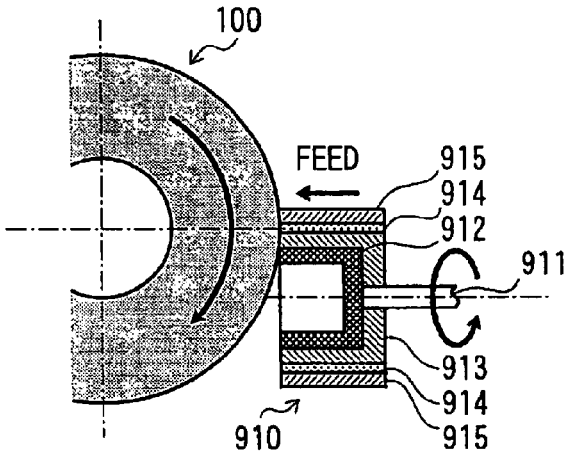
FIG. 21 is a representation of an embodiment of a truing/dressing device according to the present invention that has a dual-ring rotary electrodes inside which a conventional grindstone (nonconductive grindstone) is disposed.

FIG. 21 is a representation of an embodiment of a truing/dressing device according to the present invention that has a dual-ring rotary electrodes inside which a conventional grindstone (nonconductive grindstone) is disposed.

As shown in FIG. 21, a conventional grindstone (nonconductive grindstone) 912 is disposed inside dual-ring rotary electrodes 910 comprising an electrode inner ring 913, an insulating layer 914, and an electrode outer ring 915 that are rotated by the rotating main shaft 911 of the dual-ring rotary electrodes 910.

With these features, even if the electrode material adheres to the projecting portions (portions where deflections are large) of the trued/dressed grindstone 100 as a result of performing truing/dressing, the adhered electrode material can be reliably removed by the conventional grindstone (nonconductive grindstone) 912 disposed inside the dual-ring rotary electrodes.

Figure 22:
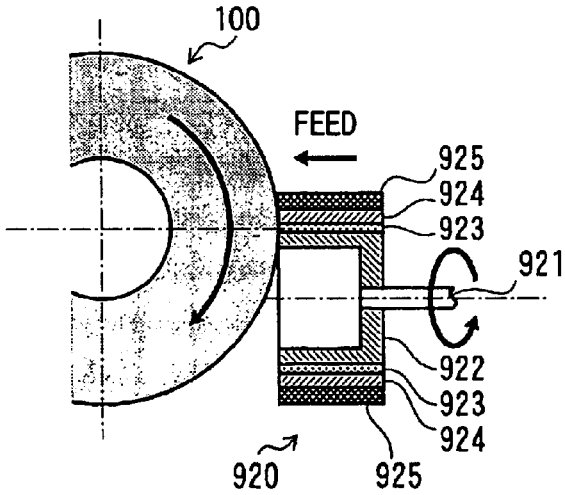
FIG. 22 is a representation of an embodiment of a truing/dressing device according to the present invention that has a dual-ring rotary electrodes outside which a conventional grindstone (nonconductive grindstone) is disposed.

FIG. 22 is a representation of an embodiment of a truing/dressing device according to the present invention that has a dual-ring rotary electrodes outside which a conventional grindstone (nonconductive grindstone) is disposed.

As shown in FIG. 22, a conventional grindstone (nonconductive grindstone) 925 is disposed outside dual-ring rotary electrodes 920 comprising an electrode inner ring 922, an insulating layer 923, and an electrode outer ring 924 that are rotated by the rotating main shaft 921 of the dual-ring rotary electrodes 920.

With these features, even if the electrode material adheres to the projecting portions (portions where deflections are large) of the trued/dressed grindstone 100 as a result of performing truing/dressing, the adhered electrode material can be reliably removed by the conventional grindstone (nonconductive grindstone) 925 disposed outside the dual-ring rotary electrodes.

The present invention is not limited to the above-described embodiments. Various modifications may be made on the basis of the true spirit of the present invention, and these modifications are not excluded from the scope of the present invention.

As described above in detail, the present invention has effects as follows.

(A) Truing/dressing of a superabrasive grindstone, especially a superabrasive grindstone having a metal binder can be very simply performed.

(B) High-precision shape creating work can be achieved.

(C) On-board truing/dressing can be performed by a dry grinding machine.

(D) Irrespective of whether a conductive grindstone or nonconductive grindstone, truing/dressing with respect thereto can be performed by the identical device.

(E) A grindstone working surface with high circularity can be attained.

(F) Because of low wear of the electrodes, greater economy can be achieved, and work environment can be conserved in a clean state.

(G) A sharp V-shaped edge shape can be easily created.

(H) The circularity of the grindstone can be monitored while conducting truing/dressing. As a result, truing/dressing condition that is appropriate for the occasion can be provided.

(I) In in-process truing/dressing, working is performed while correcting the tool path.

(J) Even if the electrode material adheres to the projecting portions (portions where deflections are large) of the trued/dressed grindstone as a result of performing truing/dressing, the adhered electrode material can be reliably removed by the conventional grindstone (nonconductive grindstone) disposed inside or outside the dual-ring rotary electrodes.

INDUSTRIAL APPLICABILITY

The contact-discharge truing/dressing method and the device therefor according to the present invention are capable of very simply conducting truing/dressing of a superabrasive grindstone, especially a superabrasive grindstone having a metal binder. The present contact-discharge truing/dressing device is, therefore, suitable for a contact-discharge device capable of high-precision shape creating work.

What is claimed is:

1. A contact-discharge truing/dressing method, comprising:

bringing a rotated conductive grindstone to be trued/dressed into contact with a pair of electrodes to which a DC voltage or pulse voltage is applied, and subjecting said conductive grindstone to be trued/dressed to an intermittent truing/dressing by contact discharge produced when opening/closing a circuit comprising a positive electrode, electrode chips on the positive electrode side, a grindstone binder, electrode chips on a negative electrode side, and the negative electrode, wherein parts of side surfaces of dual-ring rotary electrodes insulated by an insulator are used as a pair of electrodes.

2. A contact-discharge truing/dressing method, comprising:

bringing a rotated nonconductive grindstone to be trued/dressed into contact with a pair of electrodes to which a DC voltage or pulse voltage is applied, and subjecting said nonconductive grindstone to be trued/dressed to an intermittent truing/dressing by contact discharge produced when opening/closing a circuit comprising a positive electrode, electrode chips, and a negative electrode, wherein parts of side surfaces of dual-ring rotary electrodes insulated by an insulator with a thickness of several hundred $\mu$m or less are used as a pair of electrodes.

3. A contact-discharge truing/dressing method according to claim 1 or 2, wherein said contact-discharge is performed in an environment of a liquid, a mist, or the air.

4. A contact-discharge truing/dressing method according to claim 1 or 2, wherein, in order to remove initial rotational deflections of the side surfaces of said dual-ring rotary electrodes, after the side surfaces of said electrodes have been ground by said grindstone to be trued/dressed without applying a voltage between said electrodes, truing/dressing is started with a voltage applied between said electrodes.

5. A contact-discharge truing/dressing method according to claim 1 or 2, wherein a grindstone is disposed inside said dual-ring rotary electrodes, and wherein adherents of the electrode material adhering to said grindstone to be trued/dressed are removed for every discharge.

6. A contact-discharge truing/dressing method according to claim 1 or 2, wherein a grindstone is disposed outside said dual-ring rotary electrodes, and wherein adherents of the electrode material adhering to said grindstone to be trued/dressed are removed for every discharge.

7. A contact-discharge truing/dressing device wherein a rotated conductive grindstone to be trued/dressed is brought into contact with a pair of electrodes to which a DC voltage or pulse voltage is applied, and wherein said conductive grindstone to be trued/dressed is subjected to an intermittent truing/dressing by contact discharge produced when opening/closing a circuit comprising a positive electrode, electrode chips on the positive electrode side, a grindstone binder, electrode chips on a negative electrode side, and the negative electrode, said contact-discharge truing/dressing device comprising:

(a) dual-ring rotary electrodes insulated by an insulator; and (b) a pair of electrodes of said positive electrode and said negative electrode and comprising parts of side surfaces of said dual-ring rotary electrodes.

8. A contact-discharge truing/dressing device wherein a rotated nonconductive grindstone to be trued/dressed is brought into contact with a pair of electrodes to which a DC voltage or pulse voltage is applied, and wherein said nonconductive grindstone to be trued/dressed is subjected to an intermittent truing/dressing by contact discharge produced when opening/closing a circuit comprising a positive electrode, electrode chips, and a negative electrode, said contact-discharge truing/dressing device comprising:

(a) dual-ring rotary electrodes insulated by an insulator with a thickness of several hundred $\mu$m or less; and (b) a pair of electrodes of said negative electrode and said positive electrode and comprising parts of side surfaces of said dual-ring rotary electrodes.

9. A contact-discharge truing/dressing device according to claim 7 or 8, further comprising a drive mechanism for driving said dual-ring rotary electrodes in the rotating shaft direction thereof.

10. A contact-discharge truing/dressing device according to claim 9, further comprising a structure capable of applying a voltage between dual-ring rotary electrodes with mutually different diameters.

11. A contact-discharge truing/dressing method, comprising obtaining, using the device according to claim 9, a predetermined shape of the edge of a grindstone, by providing said electrodes with a feed in the rotating shaft direction thereof in state in which a predetermined angle is formed between the rotating shaft of said electrodes and that of said grindstone to be trued/dressed.

12. A contact-discharge truing/dressing method, comprising disposing, using the device according to claim 9, a drive device for said dual-ring rotary electrodes, on a numerical-control moving table having a crosswise movement mechanism an a rotational mechanism, to thereby perform high-precision form truing/dressing.

13. A contact-discharge truing/dressing method, comprising inserting, using the device according to claim 9, a contact-discharge current limiting resistor and a current detector on the side of the power supply circuit of said device so as to be in series with said pair of electrodes, whereby the feed speed of said dual-ring rotary electrodes in the rotating shaft direction thereof is numerically controlled so that the power consumption between said electrodes becomes the maximum when the contact-discharge current takes on the peak value $I_p$.

14. A contact-discharge truing/dressing method, comprising disposing, in the contact-discharge truing/dressing device according to claim 9, a displacement sensor for measuring the positions of the side surfaces of said electrodes, on the side-surface side of said electrodes to thereby perform truing/dressing while measuring the truing amount.

15. A contact-discharge truing/dressing device according to claim 9, further comprising a displacement sensor for measuring the positions of the side surfaces of said electrodes, said displacement censor being provided on the side-surface side of said electrodes.

16. A contact-discharge truing/dressing device according to claim 7 or 8, further comprising a grindstone disposed outside said dual-ring rotary electrodes.

17. A contact-discharge truing/dressing device according to claim 7 or 8, further comprising a structure capable of applying voltage between dual-ring rotary electrodes with mutually different diameters.

18. A contact-discharge truing/dressing method, comprising obtaining, using the device according to claim 7 or 8, a predetermined shape of the edge of a grindstone, by providing said electrodes with a feed in the rotating shaft direction thereof in a state in which a predetermined angle is formed between the rotating shaft of said electrodes and that of said grindstone to be trued/dressed.

19. A contact-discharge truing/dressing method, comprising disposing, using the device according to claim 7 or 8, a drive device for said dual-ring rotary electrodes, on a numerical-control moving table having a crosswise movement mechanism and a rotational mechanism, to thereby perform high-precision form truing/dressing.

20. A contact-discharge truing/dressing method, comprising inserting, using the device according to claim 7 or 8, a contact-discharge current limiting resistor and a current detector on the side of the power supply circuit of said device so as to be in series with said pair of electrodes, whereby the feed speed of said dual-ring rotary electrodes in the rotating shaft direction thereof is numerically controlled so that the power consumption between said electrode becomes the maximum when the contact-discharge current takes on the peak value $I_p$.

21. A contact-discharge truing/dressing method according to claim 20, wherein the mean value $I_m$ and die peak value $I_p$ of the output from said current detector are acquired at a period of one or more revolutions of said grindstone to be trued/dressed, and wherein truing/dressing is performed while estimating the circularity of said grindstone to be trued/dressed, based on the value of $I_m/I_p$.

22. A contact-discharge truing/dressing method according to claim 21, wherein, based on said estimated circularity of said grindstone to be trued/dressed, the magnitude of contact-discharge power consumption $E\text{-}I_p/2$ is automatically adjusted by a numerical control or an automatic control to thereby perform high-precision truing/dressing.

23. A contact-discharge truing/dressing method according to claim 21, wherein, when the estimated circularity of said grindstone to be trued/dressed becomes a predetermined value or less, the truing/dressing is automatically ended.

24. A contact-discharge truing/dressing method according to claim 20, wherein, in order that a control is performed more stably, the kind of the applied voltage to said dual-ring rotary electrodes is automatically switched between said DC voltage and pulse voltage.

25. A contact-discharge truing/dressing method, comprising disposing, in the contact-discharge truing/dressing device according to claim 7 or 8, a displacement sensor for measuring the positions of the side surfaces of said electrodes, on the side-surface side of said electrodes to thereby perform truing/dressing while measuring the truing amount.

26. A contact-discharge truing/dressing method according to claim 25, wherein said contact-discharge truing/dressing method is applied to in-process truing/dressing to thereby execute said method while correcting the tool path based on the truing amount.

27. A contact-discharge truing/dressing device according to claim 7 or 8, further comprising a displacement sensor for measuring the positions of the side surfaces of said electrodes, said displacement censor being provided on the side-surface side of said electrodes.

28. A contact-discharge truing/dressing device according to claim 7 or 8, further comprising a grindstone disposed inside said dual-ring rotary electrodes.

* * * * *